US008585040B2

(12) United States Patent
Ikeda et al.

(10) Patent No.: US 8,585,040 B2
(45) Date of Patent: Nov. 19, 2013

(54) SHEET FEEDER AND IMAGE FORMING APPARATUS USING THE SAME

(75) Inventors: Aki Ikeda, Kanagawa (JP); Manabu Nonaka, Kanagawa (JP); Yoshikuni Ishikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/413,704

(22) Filed: Mar. 7, 2012

(65) Prior Publication Data

US 2012/0235346 A1 Sep. 20, 2012

(30) Foreign Application Priority Data

Mar. 16, 2011 (JP) ..... 2011-057652

(51) Int. Cl.
*B65H 3/16* (2006.01)
*B65H 3/20* (2006.01)
*B65H 3/04* (2006.01)

(52) U.S. Cl.
USPC ..... 271/18.1; 271/34; 271/10.06; 271/33; 271/18.2

(58) Field of Classification Search
USPC ..... 271/33, 34, 18.1, 18.2, 10.06, 147
See application file for complete search history.

(56) References Cited

U.S. PATENT DOCUMENTS 8,157,257 B2 * 4/2012 Toyooka et al. ..... 271/18.1
8,267,394 B2 * 9/2012 Higaki et al. ..... 271/18.2
2010/0296851 A1 * 11/2010 Toyooka et al. ..... 399/388
2011/0121506 A1 * 5/2011 Ishikawa et al. ..... 271/18.1
2011/0227275 A1 * 9/2011 Poh et al. ..... 271/18.1
2012/0061904 A1 * 3/2012 Higaki et al. ..... 271/34
2012/0228817 A1 * 9/2012 Kobayashi et al. ..... 271/34

FOREIGN PATENT DOCUMENTS

JP H04-251041 A 9/1992
JP 09-278206 A 10/1997
JP 2004026314 A 1/2004
JP 2010089955 A 4/2010
JP 2010-269872 A 12/2010
JP 2010-269873 A 12/2010

* cited by examiner

*Primary Examiner* — Patrick Cicchino
(74) *Attorney, Agent, or Firm* — Harness, Dickey & Pierce P.L.C.

(57) ABSTRACT

A sheet feeder includes a loading member, an attraction separation unit, and a control device. The loading member carries sheet materials. The attraction separation unit includes an endless dielectric belt, holding rollers, and an adjustment device. The endless belt attracts and holds the uppermost one of the sheet materials. The holding rollers holding the endless belt include upstream and downstream holding rollers. The upstream holding roller is rotated around a shaft of the downstream holding roller as the rotation axis in accordance with rotation of the downstream holding roller. The adjustment device provided to the upstream holding roller adjusts the movement range of the upstream holding roller in the height direction. The control device controls, in accordance with the type of sheet materials, an operation of lifting and lowering the loading member, to thereby allow the adjustment device to adjust the movement range of the upstream holding roller.

10 Claims, 7 Drawing Sheets

SHEET FEEDER AND IMAGE FORMING APPARATUS USING THE SAME

CROSS-REFERENCE TO RELATED APPLICATION

This patent application is based on and claims priority pursuant to 35 U.S.C. §119 to Japanese Patent Application No. 2011-057652, filed on Mar. 16, 2011, in the Japanese Patent Office, the entire disclosure of which is hereby incorporated by reference herein.

FIELD OF THE INVENTION

The present invention relates to a sheet feeder for use in an image forming apparatus and an image forming apparatus using the sheet feeder.

BACKGROUND OF THE INVENTION

Methods of separating and feeding stacked sheets, such as documents and recording sheets include frictional, vacuum, and electrostatic methods.

The frictional feeding method using frictional force uses, for example, a rubber material to form a feed roller. Changes in the properties of the feed roller over time due to abrasion, etc., may cause a change in frictional force and degrade feeding performance. Further, when sheets varying or not uniform in coefficient of friction or sheets having different coefficients of friction are separated and fed in the same feeding operation, a feeding failure, such as simultaneous multiple feeding of a plurality of sheets and a failure to separate sheets, may occur. Further, the method is based on a configuration that separates sheets by applying pressure thereto in the sheet feeding operation, and thus may stain the sheets.

The vacuum feeding method using air suction is a non-frictional separation method not relying on the coefficient of friction of rollers and sheets. The method, however, uses an air suction blower and an air duct. Thus, the sheet feeder according to the method is increased in size, and air suction sound causes noise. Therefore, the sheet feeder is not suitable for use in an office environment.

The electrostatic feeding method using electrostatic attraction includes a variety of sheet separation methods all involving manipulating a sheet attraction unit or a sheet loading unit.

In a conventional sheet feeder based on the electrostatic attraction separation method, an alternating voltage is applied to a surface of an endless dielectric belt wound around a plurality of rollers to form a charge pattern on the surface. Then, the endless belt is swung or translated relative to a stacked sheet bundle and brought into contact with or proximity to the sheet bundle to attract the uppermost sheet of the sheet bundle to the endless belt. Thereafter, the endless belt is moved in a direction separating from the sheet bundle to separate and feed the uppermost sheet from the sheet bundle. The method, which is a type of non-frictional separation method, is advantageous in preventing abrasion, sheet damage, and noise, and in allowing a reduction in size of the sheet feeder.

Most background sheet feeders using electrostatic attraction employ a method of lifting and lowering a sheet loader bottom plate with every operation of attracting and separating a sheet. In such background sheet feeders, an attraction device is basically stationary. In some of the background sheet feeders, however, the downstream side of the attraction device is lifted, or the upstream side of the attraction device is lowered to hang.

In recent years, sheet feeders employing a method of lifting and lowering the entire attraction device have become more common. According to this arrangement, the bottom plate is lifted to a predetermined height after a sheet feeding tray is set in the sheet feeder, or the bottom plate brought into contact with the attraction device is lowered to and stopped at the predetermined height. Thereafter, the attraction device is lifted and lowered to perform the operation of attracting and feeding each sheet. During the operation, the attraction device, specifically a belt unit, swings with the upstream side thereof in the sheet feeding direction hanging down, thereby turning a sheet from a sheet bundle.

According to the sheet feeders employing the above-described method using electrostatic attraction, in the separation of the endless belt from the stacked sheet bundle, the sheet separation performance is substantially affected by the distance of separation of the endless belt from the stacked sheet bundle according to the lifting of the endless belt and by the angle of the separated endless belt relative to the upper surface of the sheet bundle. An increase in the angle of the endless belt should improve the sheet separation performance in accordance with the rigidity or firmness of the sheet, even if the separation distance is unchanged. The increase in the angle of the endless belt, however, may cause the sheet attracted to the endless belt to separate from the endless belt owing to the resilience of the sheet. That is, the optical separation distance and angle of the endless belt varies depending on the type of sheet. Yet in the background sheet feeders, which simply translate or swing the endless belt, each of the separation distance and the angle of the endless belt is set to a fixed value. It is therefore difficult to appropriately adjust the characteristics of the separation distance and the angle of the endless belt.

SUMMARY OF THE INVENTION

The present invention describes a novel sheet feeder. In one example, a novel sheet feeder includes a loading member, an attraction separation unit, and a control device. The loading member is configured to carry a sheet bundle of a plurality of sheet materials loaded thereon. The attraction separation unit includes an endless belt, a plurality of holding rollers, and an adjustment device. The endless belt is made of a dielectric material, and configured to electrostatically attract and hold an uppermost sheet material of the sheet bundle loaded on the loading member. The plurality of holding rollers are configured to hold the endless belt, and include an upstream holding roller located on the upstream side in the feeding direction of the sheet materials and a downstream holding roller located on the downstream side in the feeding direction of the sheet materials. The upstream holding roller is configured to be pivoted around an axis concentric with a shaft of the downstream holding roller in accordance with rotation of the downstream holding roller. The adjustment device is provided to the upstream holding roller, and is configured to adjust the range of vertical movement of the upstream holding roller in the height direction. The control device is operatively connected to the loading member and is configured to control, in accordance with the type of sheet materials to be fed, an operation of lifting and lowering the loading member, to thereby allow the adjustment device to adjust the range of movement of the upstream holding roller in the height direction.

The control device may control, in accordance with the type of sheet materials to be fed, a start time of an operation of lifting the loading member to allow the attraction separation unit to start attracting the uppermost sheet material and a start time of an operation of lowering the loading member.

The adjustment device may include a stopper member configured to regulate, during separation of the endless belt from the sheet bundle loaded on the loading member, the angle of the endless belt with respect to the upper surface of the sheet bundle. The control device may control, in accordance with the type of sheet materials to be fed, the operation of lifting and lowering the loading member, to thereby maintain, during the separation, a constant separation distance between the upstream holding roller and the upper surface of the sheet bundle loaded on the loading member.

The control device may reduce, in accordance with an increase in rigidity of the sheet materials, the angle of the endless belt with respect to the upper surface of the sheet bundle loaded on the loading member.

The above-described sheet feeder may further include a first detection device configured to detect, on the basis of lifting and lowering of the loading member, the contact of a surface of the endless belt with the upper surface of the sheet bundle loaded on the loading member, and a second detection device configured to detect the position of the upstream holding roller.

The above-described sheet feeder may further include a detection device configured to detect, on the basis of lifting and lowering of the loading member, the contact of a surface of the endless belt with the upper surface of the sheet bundle loaded on the loading member, and detect the position of the upstream holding roller.

The above-described sheet feeder may further include an operation unit configured to be operated by a user to select the type of sheet materials. The control device may control, in accordance with the type of sheet materials selected through the operation unit, the operation of lifting and lowering the loading member.

The above-described sheet feeder may further include a lifting and lowering device configured to perform an operation of lifting and lowering the attraction separation unit. The control device may control the operation of lifting and lowering the attraction separation unit, instead of the operation of lifting and lowering the loading member.

The lifting and lowering device may perform an operation of lowering the attraction separation unit by causing the attraction separation unit to free fall. The adjustment device may include a movement range regulator configured to regulate the distance of the attraction separation unit falls during freefall of the attraction separation unit.

The present invention further describes a novel image forming apparatus. In one example, a novel image forming apparatus includes an image forming unit configured to form an image on a sheet material and the above-described sheet feeder configured to separate an uppermost sheet material from a sheet bundle of a plurality of stacked sheet materials and feed the uppermost sheet material to the image forming unit.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
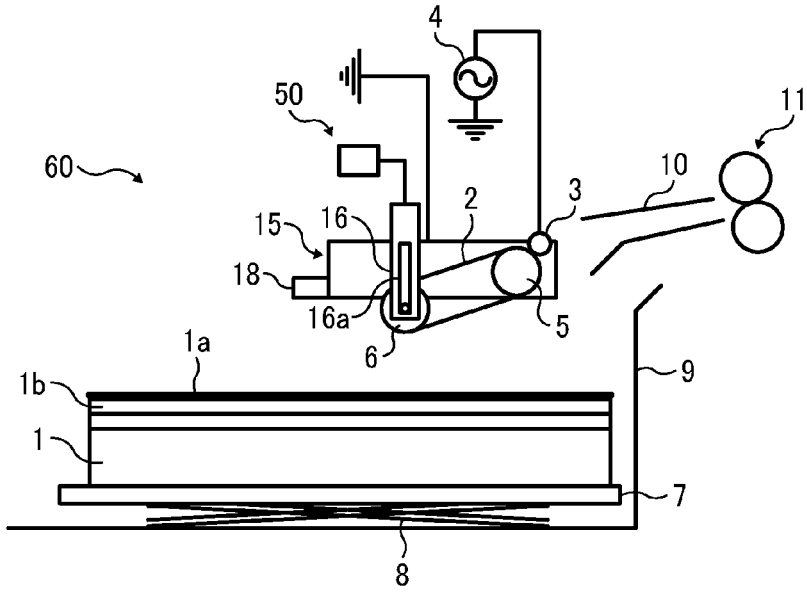
FIG. 1 is a schematic diagram of a sheet feeder according to a first embodiment of the present invention.
Figure 2:
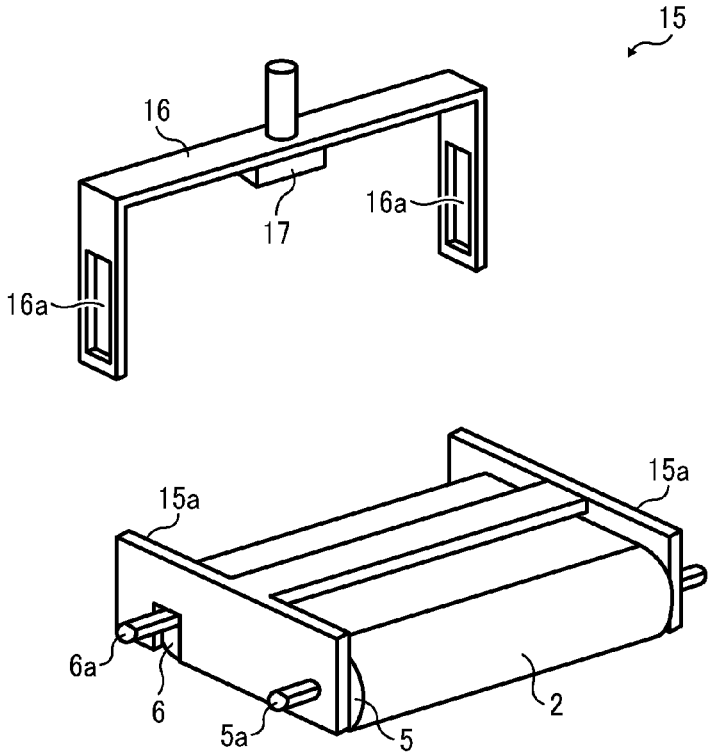
FIG. 2 is an exploded perspective view of an attraction separation unit of the sheet feeder according to the first embodiment.
Figure 3:
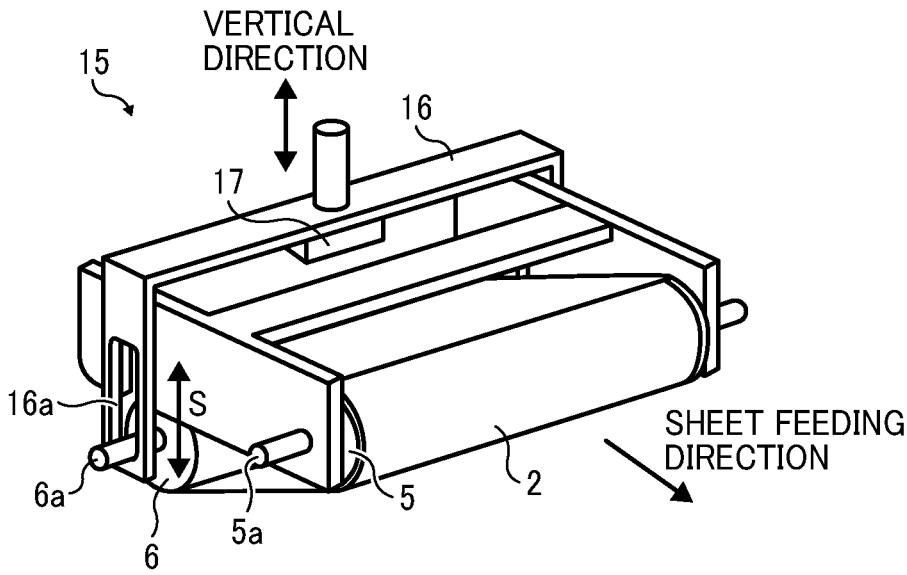
FIG. 3 is a perspective view of an assembled attraction separation unit included in the sheet feeder.
Figure 4:
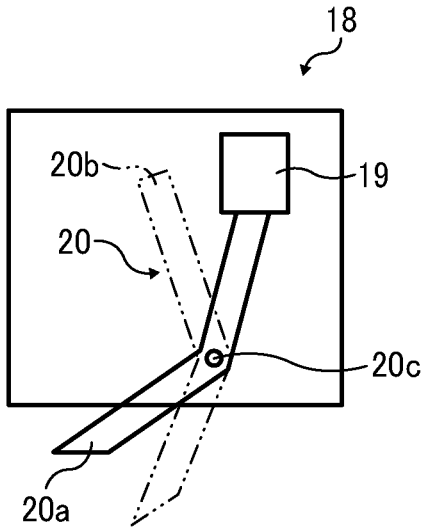
FIG. 4 is a schematic structure of a sensor unit provided in the sheet feeder.

In describing embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, embodiments of the present invention will be described.

To improve sheet separation and feeding performance by appropriately setting, in accordance with the type of a sheet material, the separation distance of an endless dielectric belt from the sheet material during the lifting of the endless belt and the angle of the separated endless belt, an embodiment of the present invention is configured as follows. That is, the endless belt of an attraction separation unit is held by a plurality of holding rollers, which include an upstream holding roller located on the upstream side in the feeding direction of the sheet material and a downstream holding roller located on the downstream side in the feeding direction of the sheet material. The upstream holding roller is rotated around a shaft of the downstream holding roller as the axis of rotation in accordance with rotation of the downstream holding roller. Further, the upstream holding roller is provided with an adjustment device which adjusts the range of movement of the upstream holding roller in the height direction. An operation of lifting and lowering a loading member is controlled in accordance with the type of sheet material, to thereby allow the adjustment device to adjust the range of movement of the upstream holding roller in the height direction.

Detailed description of embodiments of the present invention will now be made on the basis of the drawings. In the following, the caret "^" denotes exponentiation.

A first embodiment of the present invention will be first described. On the basis of FIGS. 1 to 4, description will be made of a configuration of a sheet feeder 60 using an attraction separation unit 15. The sheet feeder 60 illustrated in the drawings uses, as an attraction device serving as a pickup member, an endless belt 2 made of a dielectric material and wound around a downstream holding roller 5 and an upstream holding roller 6. The driving of the upstream and downstream holding rollers 6 and 5 is performed such that the downstream holding roller 5 is driven to drive the upstream holding roller 6 via the endless belt 2. The upstream holding roller 6 is biased by springs to apply tension to the endless belt 2. The endless belt 2 is made of a dielectric material having a resistance of approximately 10^8 Ω·cm (ohm centimeters) or more, such as a film made of, for example, polyethylene terephthalate having a thickness of approximately 100 μm. The downstream holding roller 5 has an outer circumferential surface provided with a conductive rubber layer having a resistance value of approximately 10^6 Ω·cm, and the upstream holding roller 6 is a metal roller. The downstream holding roller 5 and the upstream holding roller 6 are both grounded.

Figure 5:
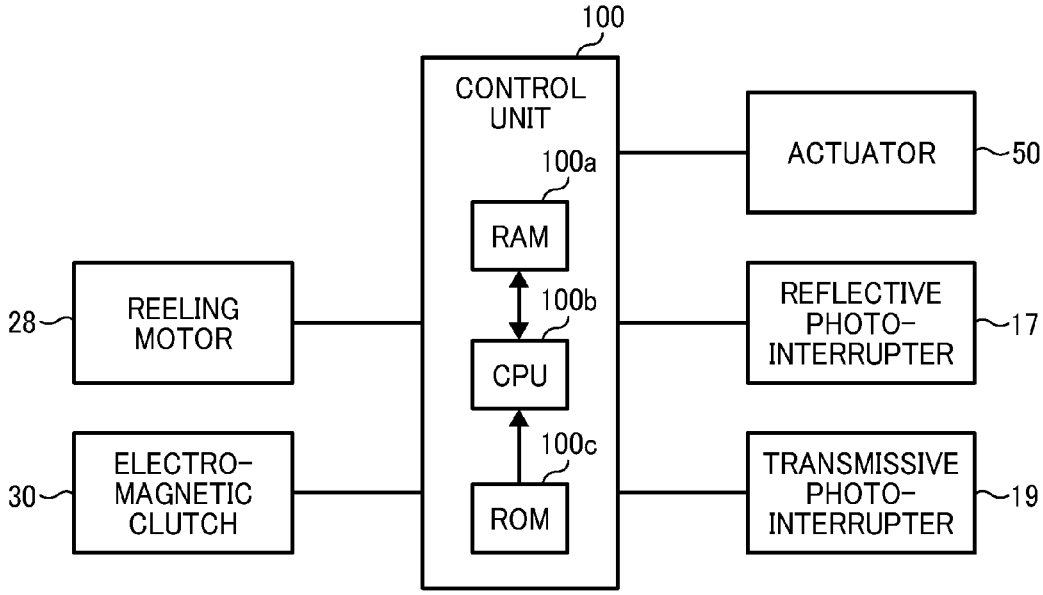
FIG. 5 is a schematic diagram of a control unit provided for controlling units and components included in the sheet feeder.

On the downstream side of the endless belt 2 in the sheet feeding direction, guide plates 10 for guiding the feeding of sheets of a sheet bundle 1 and a feed roller pair 11 are provided. The sheet bundle 1 includes an uppermost sheet 1*a* and a second sheet 1*b*. The downstream holding roller 5 serving as a drive roller is intermittently driven by a drive motor via an electromagnetic clutch (e.g., an electromagnetic clutch 30 as illustrated in FIG. 5) in accordance with a sheet feeding signal. The feed roller pair 11 and the endless belt 2 are set to the same linear velocity. If the feed roller pair 11 is intermittently driven to adjust the feed timing, the endless belt 2 is controlled to be also intermittently driven.

The attraction separation unit 15 is fixed with a roller electrode 3 connected to a power supply 4 which generates an alternating-current (hereinafter referred to as AC) voltage. The roller electrode 3 is in contact with the endless belt 2 at a position at which the endless belt 2 is wound around the downstream holding roller 5. As well as the AC voltage, a direct-current (hereinafter referred to as DC) voltage alternated between high and low potentials may be provided by the power supply 4. The waveform of the voltage may be, for example, a rectangular or sine wave. Further, a charging blade having a plate shape may be used as the electrode.

The upstream holding roller 6 is configured to be swingable in the vertical direction around a shaft 5*a* of the downstream holding roller 5 as the rotation center. Rotational force is generated in the upstream holding roller 6 owing to the self-weight thereof. A groove-like stopper 16 having an opening facing downward regulates the angle of swing to prevent the upstream holding roller 6 from moving lower than a predetermined height. Specifically, respective flange-like portions on the opposite sides of the stopper 16 are provided with elongated holes 16*a* extending in the vertical direction, and a shaft 6*a* of the upstream holding roller 6 passes through the elongated holes 16*a*. Thereby, the upstream holding roller 6 is allowed to move in the vertical direction by the vertical size of the elongated holes 16*a*, which corresponds to a later-described descent distance S illustrated in FIG. 3. Further, the shaft 5*a* of the downstream holding roller 5 is inserted through and rotatably supported by respective side plates 15*a* of the attraction separation unit 15.

Further, an actuator 50 is provided to adjust a relative position in a direction of height of the stopper 16 with respect to the respective side plates 15*a* of the attraction separation unit 15. The actuator 50 is controlled by a control unit 50, which is illustrated in FIG. 5 and explained later, to move the stopper 16 in a lift direction or a lowering direction. In the present invention, a solenoid is used as the actuator 50. Alternatively, a drive unit, such as a stepping motor, to pull or apply traction to a wire that is suspended from above, with respect to the stopper 16 that may fall by its weight can be employed.

As a device for detecting the position of the upstream holding roller 6, a reflective photo-interrupter 17 is provided to a portion of the stopper 16 connecting the flange-like portions on the opposite sides thereof, with the detection direction of the reflective photo-interrupter 17 set downward. That is, when the upstream holding roller 6 swings and reaches a height substantially the same as the height of the downstream holding roller 5, and thereby places the outer circumferential surface of the endless belt 2 substantially perpendicular to a downward optical axis of the reflective photo-interrupter 17, the reflective photo-interrupter 17 receives light and outputs a signal indicating a light reception state. If the height of the upstream holding roller 6 is lower than the height of the downstream holding roller 5 and the surface of the endless belt 2 is tilted relative to the horizontal direction, the reflective photo-interrupter 17 outputs a signal indicating a light non-reception state.

A sheet tray 9 in FIG. 1 includes a bottom plate 7 for carrying the sheet bundle 1 loaded thereon and bottom plate lifting arms 8 for lifting and lowering the bottom plate 7.

An upstream portion of the attraction separation unit 15 is provided with a sensor unit 18 serving as a first detection device which detects the contact of the uppermost sheet 1*a* of the sheet bundle 1 loaded on the bottom plate 7 lifted by the bottom plate lifting arms 8 with the endless belt 2 of the attraction separation unit 15. The sensor unit 18 includes a transmissive photo-interrupter 19, a sensor feeler 20, and a sensor unit housing 21 for fixedly supporting the transmissive photo-interrupter 19 and rotatably supporting the sensor feeler 20. The transmissive photo-interrupter 19 includes a light emitting element and a light receiving element. The sensor feeler 20 includes a detection surface 20*a* hanging down from the attraction separation unit 15 toward the bottom plate 7, a light shielding plate 20*b* for switching between light shielding and light transmission of the transmissive photo-interrupter 19, and a feeler shaft 20*c*.

That is, as illustrated in FIGS. 1 to 4, the present embodiment is configured such that the bottom plate 7 serving as a loading member for carrying the sheet bundle 1 loaded thereon is lifted and lowered, and that the attraction separation unit 15 serving as a sheet feeding unit swings in the vertical direction around a downstream position in the sheet feeding direction, which does not necessarily correspond to the shaft 5*a* of the downstream holding roller 5, with the endless belt 2 wound around the upstream holding roller 6 and the downstream holding roller 5.

When the sheet feeder 60 is in a standby state, i.e., when the endless belt 2 as a constituent member of the attraction separation unit 15 is not in contact with the sheet bundle 1 loaded on the bottom plate 7 with a space of at least a predetermined distance formed between the endless belt 2 and the sheet bundle 1, the upstream holding roller 6 inside the endless belt 2 is located lower than the downstream holding roller 5, and the surface of the endless belt 2 is tilted relative to the horizontal direction. Therefore, the signal output from the reflective photo-interrupter 17 serving as a position detection device (second detection device) for detecting the position of the upstream holding roller 6 indicates the light non-reception state. Further, in the sensor unit 18 serving as the first detection device, the detection surface 20*a* of the sensor feeler 20 hangs down owing to the self-weight thereof without receiving external force, and the light shielding plate 20*b* is located between the light emitting element and the light receiving element of the transmissive photo-interrupter 19. Therefore, the signal output from the transmissive photo-interrupter 19 indicates a light shielding state.

An operation of the attraction separation unit 15 will now be described on the basis of FIGS. 5 to 10.

FIG. 5 illustrates a schematic diagram of a control unit 100. The control unit 100 of FIG. 5 includes a RAM (Random Access Memory 100*a*, a CPU (Central Processing Unit) 100*b*, a ROM (Read Only Memory) 100*c* and so forth. The control unit 10 is connected to the actuator 50, the reflective photo-interrupter 17, the transmissive photo-interrupter 19, a reeling motor 28 (described later), the electromagnetic clutch 30, and so forth.

Figure 6:
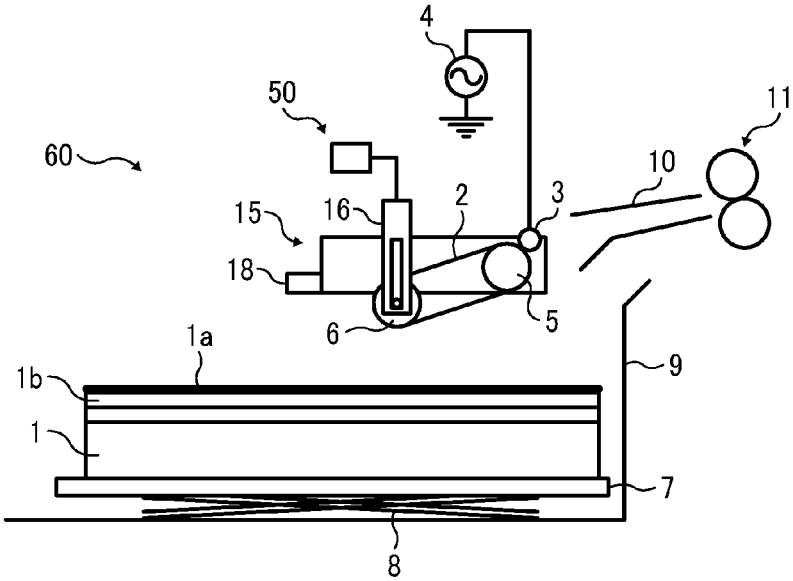
FIG. 6 is a schematic diagram illustrating a standby state of the sheet feeder according to the first embodiment.
Figure 7:
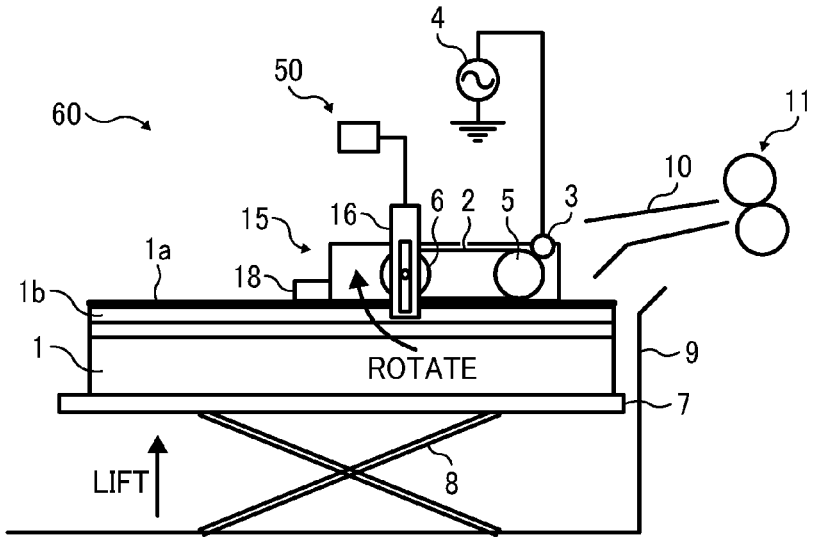
FIG. 7 is a schematic diagram illustrating the sheet feeder according to the first embodiment lifting a bottom plate.

The attraction separation unit 15 normally stands by at the position and in the state illustrated in FIG. 6. Upon receipt of a sheet feeding signal from, for example, an image forming apparatus 51, which will be described later, the electromagnetic clutch 30 is first turned on, and the downstream holding roller 5 is driven to rotate. Then, an alternating voltage is applied to the endless belt 2 by the power supply 4 via the roller electrode 3 to form a pattern of charges alternating with a pitch that varies according to the frequency of the power supply 4 generating the AC voltage and the rotation speed of the endless belt 2 on the outer circumferential surface of the endless belt 2. Preferably, the pitch is set to approximately 5 mm to approximately 15 mm. After the charging of the endless belt 2, the driving of the downstream holding roller 5 is stopped.

Thereafter, upon issuance of a command to lift the bottom plate 7 from the control unit 100, the bottom plate lifting arms 8 push the bottom plate 7 upward while maintaining the bottom plate 7 in a horizontal state, so that the upper surface of the sheet bundle 1 and the endless belt 2 move toward each other. Then, the upper surface of the uppermost sheet 1*a* comes into contact with the detection surface 20*a* of the sensor feeler 20, and the sensor feeler 20 is rotated around the feeler shaft 20*c* by an external force acting on the detection surface 20*a*. As the bottom plate 7 further moves to a position at which the uppermost sheet 1*a* of the sheet bundle 1 loaded on the bottom plate 7 comes into contact with the endless belt 2 of the attraction separation unit 15, the upstream holding roller 6 rotationally moves upward around the downstream holding roller 7 as the axis of rotation. Then, upon arrival at the position illustrated in FIG. 7, at which the endless belt 2 comes into contact with the upper surface of the sheet bundle 1, the light shielding plate 20*b* of the sensor feeler 20 passes through and exits the space between the light emitting element and the light receiving element of the transmissive photo-interrupter 19, and the signal output from the transmissive photo-interrupter 19 switches to a light transmission state (from a position illustrated with a dotted line to a position illustrated with a solid line). Upon receipt of the signal from the transmissive photo-interrupter 19, the control device issues a command to stop the bottom plate 7 for a predetermined time. Thereby, the uppermost sheet 1*a* is electrostatically attracted to the endless belt 2.

After the attraction of the uppermost sheet 1*a* to the endless belt, the bottom plate 7 is lowered on a command from the control device to move the upper surface of the sheet bundle 1 and the endless belt 2 away from each other. The descent distance S of the upstream holding roller 6 is regulated by the stopper 16. Therefore, the upper surface of the sheet bundle 1 and the endless belt 2 eventually separate from each other. As illustrated in FIG. 6, the bottom plate 7 is further lowered to a height H, where the uppermost sheet 1*a* is separated from the second sheet 1*b* and the subsequent sheets.

Figure 8:
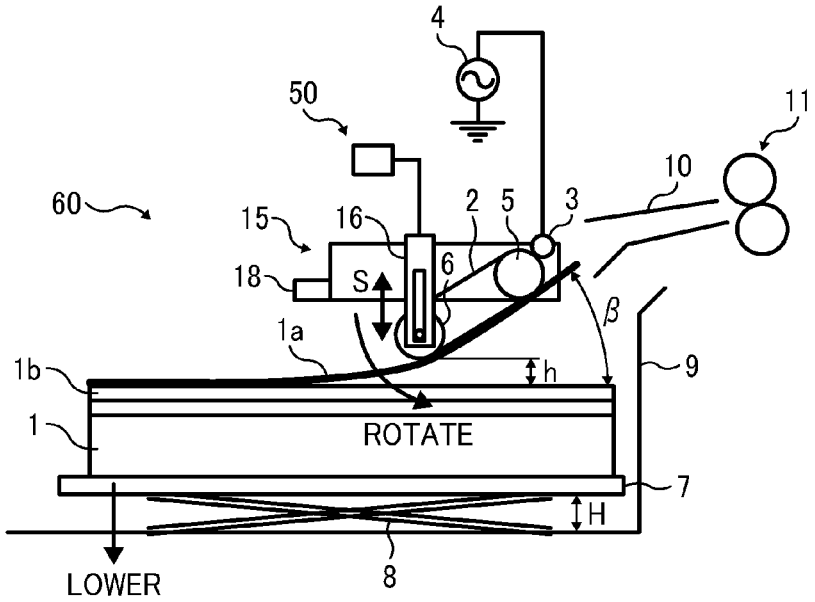
FIG. 8 is a schematic diagram illustrating the sheet feeder according to the first embodiment attracting an uppermost sheet.
Figure 9:
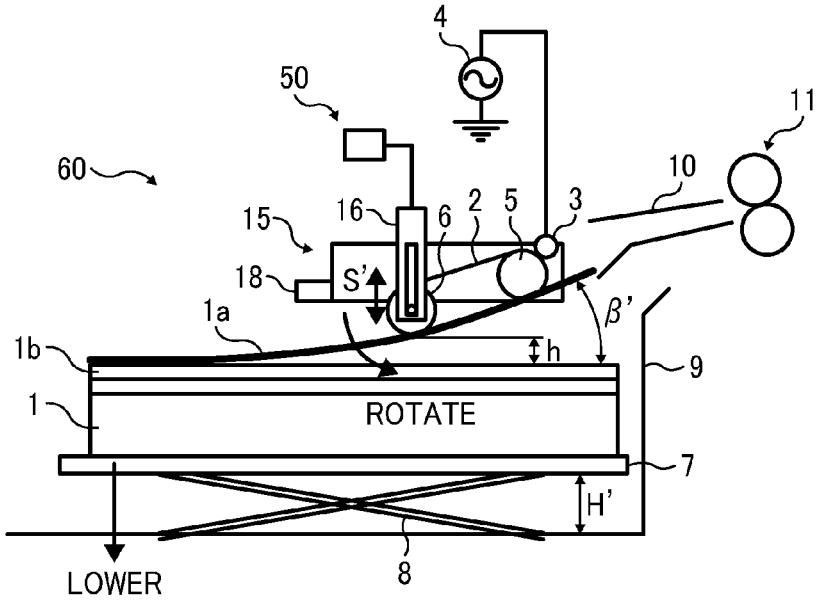
FIG. 9 is a schematic diagram illustrating the sheet feeder according to the first embodiment attracting an uppermost sheet relatively high in rigidity.
Figure 10:
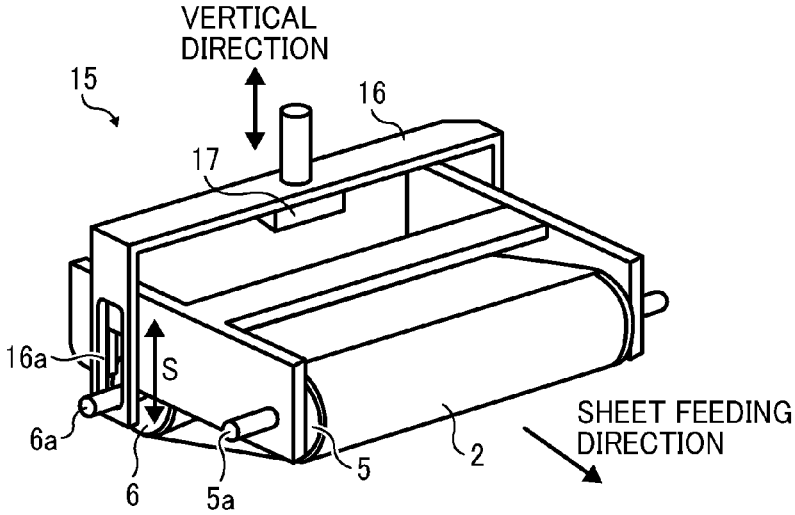
FIG. 10 is a perspective view illustrating the attraction separation unit in the state of FIG. 7.

Herein, by adjusting the angle of rotation of the upstream holding roller 6 regulated by the stopper 16, an angle β of the endless belt 2 with respect to the upper surface of the sheet bundle 1 can be changed. In general, the higher the rigidity of the sheet, the higher the resilience of the sheet, and the more likely the sheet is to separate from the surface of the endless belt 2. In the case of a sheet having relatively high rigidity, therefore, it is desired to set a relatively small belt angle, i.e., to adjust the angle β in FIG. 8 to an angle β' in FIG. 9 (β>β). FIG. 9 is a schematic diagram illustrating a sheet feeding state in which the sheets of the sheet bundle 1 are assumed to be higher in rigidity than the sheets of the sheet bundle 1 handled in FIG. 8. FIG. 10 is a perspective view illustrating the attraction separation unit 15 in the state of FIG. 9.

A separation distance h between the endless belt 2 at its lowest point and the sheet bundle 1 is determined by the angle β or β' of the endless belt 2 and the height H or H' of the bottom plate 7 (hereinafter simply referred to as the angle β and the height H, respectively). It is known that, if the separation distance h is set to a constant value regardless of the rigidity of the sheets of the sheet bundle 1, sheet separation and feeding performance is stabilized. The present embodiment, therefore, controls the vertical movement distance of the bottom plate 7 in accordance with the type of sheets of the sheet bundle 1 loaded on the bottom plate 7, to thereby appropriately adjust the separation distance h between the endless belt 2 and the sheet bundle 1 and the angle β of the endless belt 2 with respect to the upper surface of the sheet bundle 1, which substantially affect the performance of the sheet feeder 60 using electrostatic attraction. The sheet feeder 60 according to the present embodiment may be configured to include an operation unit operated by a user to select the type of sheets of the sheet bundle 1, and the control device may control the lifting and lowering of the bottom plate 7 in accordance with the selected sheet type.

After the separation of the uppermost sheet 1*a* from the second sheet 1*b*, the downstream holding roller 5 is driven to rotate, and the uppermost sheet 1*a* is separated from the endless belt 2 in accordance with the movement of the endless belt 2 owing to the curvature of the downstream holding roller 5, and is fed toward the feed roller pair 11 through the guide plates 10.

That is, the present embodiment is configured to use the stopper 16 to regulate the range of swing of the attraction separation unit 15 caused by free fall thereof. As illustrated in FIGS. 8 through 10, therefore, to maintain the separation distance h between the endless belt 2 and the sheet bundle 1 at a constant value while changing, in accordance with the rigidity of the sheets of the sheet bundle 1, the height H (H') of the bottom plate 7 serving as the loading member, the present embodiment controls the descent distance S (S') by using the stopper 16, and changes the angle β (β') of the endless belt 2 with respect to the upper surface of the sheet bundle 1. Thereby, the necessary angle is changed in accordance with the sheet rigidity.

A second embodiment of the present invention will now be described. The first embodiment is configured to include the sensor unit 18, which includes the sensor feeler 20 having the detection surface 20*a* that comes into contact with the sheet bundle 1, as the first detection device which detects the contact of the surface of the endless belt 2 with the upper surface of the sheet bundle 1. As the second embodiment, this configuration may be modified such that the above-described sensor unit 18 is not provided, and that the detection signal of the reflective photo-interrupter 17 detecting the position of the upstream holding roller 6 is used to detect that the endless belt 2 is in a substantially horizontal direction and in contact with the sheet bundle 1. In the present embodiment, the number of components is reduced, and thus a reduction in space and cost is attained.

A third embodiment of the present invention will now be described. The first and second embodiments lift and lower the bottom plate 7. The third embodiment of the present invention, however, may be configured to lift and lower the attraction separation unit 15 including the attraction device.

Figure 11:
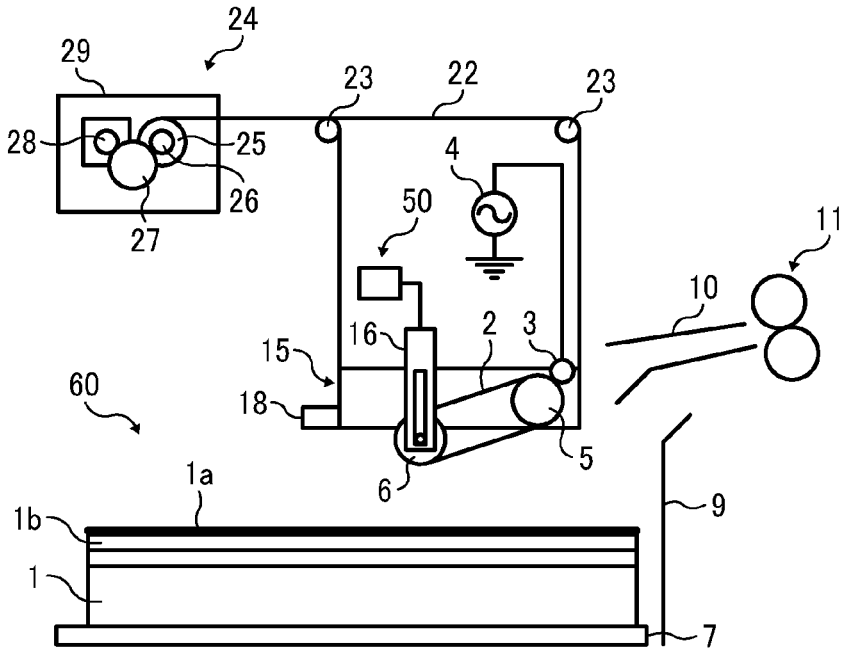
FIG. 11 is a schematic diagram of a sheet feeder including a wire reeling unit according to a third embodiment of the present invention.

In the present embodiment, the attraction separation unit 15 is supported from above by four steel wires 22, as illustrated in FIG. 11. The steel wires 22 pass over pulleys 23 fixedly disposed above the attraction separation unit 15, and are connected to a wire reeling unit 24. The wire reeling unit 24 includes a wire reeling shaft 25 fastened with the steel wires 22, a gear 26 provided on the wire reeling shaft 25, an idler gear 27, a reeling motor 28 for inputting drive to the idler gear 27, and a reeling unit housing 29 supporting the above-described components.

An operation of the present embodiment will be described on the basis of FIGS. 11 and 12. As in the first embodiment, a pattern of alternating charges is formed on the surface of the endless belt 2 of the attraction separation unit 15. Thereafter, the reeling motor 28 is rotated by a predetermined amount to rotate the wire reeling shaft 25 via the idler gear 27 and the gear 26 on the wire reeling shaft 25 to unwind the steel wires 22 and move the attraction separation unit 15 toward the bottom plate 7.

As the attraction separation unit 15 moves to a position at which the uppermost sheet 1*a* of the sheet bundle 1 loaded on the bottom plate 7 comes into contact with the endless belt 2 of the attraction separation unit 15, the upstream holding roller 6 rotationally moves upward around the downstream holding roller 5 as the axis of rotation. That the endless belt 2 is in a substantially horizontal direction and in contact with the sheet bundle 1 is detected by the reflective photo-interrupter 17, which is provided to the portion of the stopper 16 connecting the flange-like portions on the opposite side thereof, and which serves as the device for detecting the position of the upstream holding roller 6. Then, the driving of the reeling motor 28 is stopped for a predetermined time, and the uppermost sheet 1*a* is electrostatically attracted to the endless belt 2. Thereafter, the control unit 100 issues a command to drive the reeling motor 28 in a wire reeling direction, and the upper surface of the sheet bundle 1 and the endless belt 2 separate from each other. That is, in the present embodiment, the entire attraction separation unit 15 vertically moves up and down to perform a so-called turning operation of turning the uppermost sheet 1*a* from the sheet bundle 1. Operations performed thereafter are similar to the operations of the first embodiment.

Figure 12:
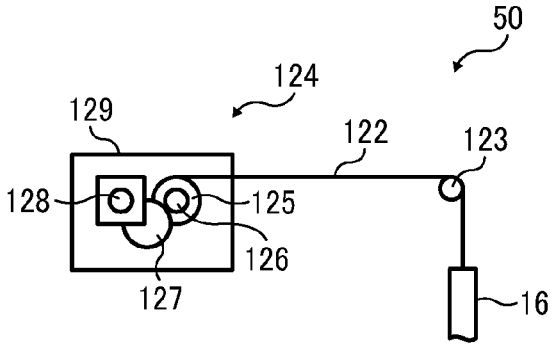
FIG. 12 is another configuration of the wire reeling unit of the sheet feeder.

In this embodiment, the actuator 50 can be configured as illustrated in FIG. 12. Specifically, the stopper 16 is suspended from above by steel wires 122. The steel wires 122 is wound around pulleys 123 that is fixedly attached and located above the stopper 16 and is connected to a wire reeling unit 124.

The wire reeling unit 124 includes a wire reeling shaft 125 to which the steel wires 122 are fastened, a gear 126 mounted on the wire reeling shaft 125, an idler gear 127, a reeling motor 128 to drive the idler gear 127, and a reeling unit housing 129 to support the wire reeling shaft 125, the gear 126, the idler gear 127, and the reeling motor 128. Further, instead of the idler gear 127, an electromagnetic clutch can be employed.

Figure 13:
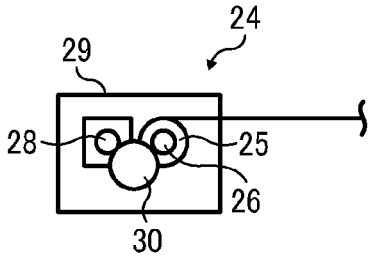
FIG. 13 is a configuration of the wire reeling unit of the sheet feeder according to a fourth embodiment of the present invention.

A fourth embodiment of the present invention will now be described. FIG. 13 illustrates, as the fourth embodiment, an example in which an electromagnetic clutch 30 replaces the idler gear 27 of the wire reeling unit 24 in the third embodiment. In the present configuration, the attraction and separation unit 15 is lifted and lowered on the basis of a control of the reeling motor 28 and the electromagnetic clutch 30. That is, to lower the attraction separation unit 15 to be located lower than the standby position, the electromagnetic clutch 30 is cut off to rotate the wire reeling shaft 25 in a direction of unwinding the steel wires 22 with the self-weight of the attraction separation unit 15. To stop the attraction separation unit 15, the electromagnetic clutch 30 is connected at arbitrary timing during a braking control of the reeling motor 28 to regulate the fall distance of the attraction separation unit 15. To lift the attraction separation unit 15 again, the reeling motor 28 is driven in the wire reeling direction to lift the attraction separation unit 15.

Figure 14:
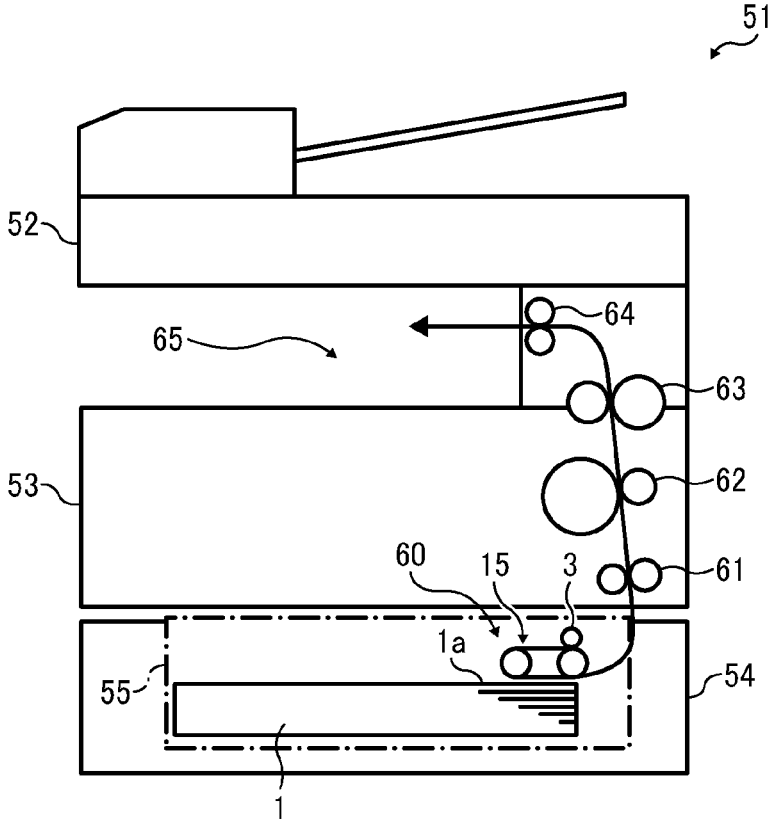
FIG. 14 is a schematic cross-sectional view illustrating a configuration of an example of an image forming apparatus according to embodiments of the present invention, including a fifth embodiment thereof.

A fifth embodiment of the present invention will now be described. FIG. 14 is a schematic cross-sectional view illustrating a configuration of an example of an image forming apparatus according to an embodiment of the present invention. A copier 51 as an example of an image forming apparatus mainly includes a document reading unit 52, an image forming unit 53, and a sheet feeding unit 54. In the copier 51, the image forming unit 53 and the sheet feeding unit 54 are separable from each other. The sheet feeding unit 54 includes a sheet feeder 60 including the attraction separation unit 15. The attraction separation unit 15 comes into contact with the upper surface of the uppermost sheet 1*a* of the sheet bundle 1 stacked on the bottom plate 7 disposed in a sheet feeding cassette 55, and feeds the uppermost sheet 1*a* by attracting and separating the uppermost sheet 1*a* from the sheet bundle 1 loaded on the bottom plate. The attraction separation unit 15 of the sheet feeder 60 may be configured as a unit detachably attachable to the sheet feeding unit 54.

As described in the foregoing embodiment, the uppermost sheet 1*a* is attracted and fed by the attraction separation unit 15 as separated from the other sheets of the sheet bundle 1. The separated and fed uppermost sheet 1*a* is then transported by a roller pair 61, and a toner image formed in the image forming unit 53 is transferred onto the uppermost sheet 1*a* in a transfer device 62 and heat-fixed on the uppermost sheet 1*a* in a fixing device 63. Thereafter, the uppermost sheet 1*a* is discharged to a sheet discharge unit 65 by discharge rollers 64.

The sheet feeders according to the embodiments of the present invention are applicable not only to the above-described copier but also to various types of image forming apparatuses according to other methods, such as an image forming apparatus according to the inkjet method, for example. Further, the sheet feeders according to the embodiments of the present invention are applicable not only to a copier but also to a facsimile machine, a printer, or a multi-function machine having the functions of at least two of these apparatuses.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A sheet feeder, comprising:

a loading member configured to carry a sheet bundle of a plurality of sheet materials loaded thereon;

an attraction separation unit including:

an endless belt made of a dielectric material, and configured to electrostatically attract and hold an uppermost sheet material of the sheet bundle loaded on the loading member, a plurality of holding rollers configured to hold the endless belt, and including an upstream holding roller located on the upstream side in the feeding direction of the sheet materials and a downstream holding roller located on the downstream side in the feeding direction of the sheet materials, the upstream holding roller configured to be pivoted around an axis concentric with a shaft of the downstream holding roller in accordance with rotation of the downstream holding roller, and an adjustment device provided to the upstream holding roller, and configured to adjust the range of vertical movement of the upstream holding roller in the height direction, a stopper member configured to regulate an angle of the endless belt with respect to an upper surface of the sheet bundle; and a control device operatively connected to the loading member and configured to control, in accordance with the type of sheet materials to be fed, an operation of lifting and lowering the loading member, to thereby allow the adjustment device to adjust the range of movement of the upstream holding roller in the height direction, wherein the control device controls, in accordance with the type of sheet materials to be fed, the operation of lifting and lowering the loading member, to thereby maintain, a constant separation distance between the upstream holding roller and the upper surface of the sheet bundle loaded on the loading member.

2. The sheet feeder according to claim 1, wherein the control device controls, in accordance with the type of sheet materials to be fed, a start time of an operation of lifting the loading member to allow the attraction separation unit to start attracting the uppermost sheet material and a start time of an operation of lowering the loading member.

3. The sheet feeder according to claim 1, wherein the stopper member is configured to regulate, during separation of the endless belt from the sheet bundle loaded on the loading member, and wherein the operation of lifting and lowering the loading member, to maintain the constant separation distance between the upstream holding roller and the upper surface of the sheet bundle loaded on the loading member is during the separation.

4. The sheet feeder according to claim 1, wherein the control device reduces, in accordance with an increase in rigidity of the sheet materials, the angle of the endless belt with respect to the upper surface of the sheet bundle loaded on the loading member.

5. The sheet feeder according to claim 1, further comprising:

a first detection device configured to detect, on the basis of lifting and lowering of the loading member, the contact of a surface of the endless belt with the upper surface of the sheet bundle loaded on the loading member; and a second detection device configured to detect the position of the upstream holding roller.

6. The sheet feeder according to claim 1, further comprising:

a detection device configured to detect, on the basis of lifting and lowering of the loading member, the contact of a surface of the endless belt with the upper surface of the sheet bundle loaded on the loading member, and detect the position of the upstream holding roller.

7. The sheet feeder according to claim 1, further comprising:

an operation unit configured to be operated by a user to select the type of sheet materials, wherein the control device controls, in accordance with the type of sheet materials selected through the operation unit, the operation of lifting and lowering the loading member.

8. The sheet feeder according to claim 1, further comprising:

a lifting and lowering device configured to perform an operation of lifting and lowering the attraction separation unit, wherein the control device controls the operation of lifting and lowering the attraction separation unit, instead of the operation of lifting and lowering the loading member.

9. The sheet feeder according to claim 8, wherein the lifting and lowering device performs an operation of lowering the attraction separation unit by causing the attraction separation unit to free fall, and wherein the adjustment device includes a movement range regulator configured to regulate the distance of the attraction separation unit falls during freefall of the attraction separation unit.

10. An image forming apparatus comprising:

an image forming unit configured to form an image on a sheet material; and a sheet feeder according to claim 1 configured to separate an uppermost sheet material from a sheet bundle of a plurality of stacked sheet materials and feed the uppermost sheet material to the image forming unit.

* * * * *